United States Patent [19]

Rekuc

[11] Patent Number: 5,048,315

[45] Date of Patent: Sep. 17, 1991

[54] CLOSURE FOR A LIDDED CONTAINER

[75] Inventor: Richard J. Rekuc, Pattenburg, N.J.

[73] Assignee: Sudhaus of America, Inc., Lebanon, N.J.

[21] Appl. No.: 586,572

[22] Filed: Sep. 21, 1990

[51] Int. Cl.[5] ..... E05B 65/48

[52] U.S. Cl. ..... 70/12; 70/75

[58] Field of Search ..... 70/75, 74, 72, 2, 6, 70/7, 8, 9, 10, 11, 12

[56] References Cited

U.S. PATENT DOCUMENTS 2,382,756 8/1945 Wagner ..... 70/75

3,184,935 5/1965 Atkinson ..... 70/75

*Primary Examiner*—Robert L. Wolfe

*Attorney, Agent, or Firm*—Herbert Dubno

[57] ABSTRACT

A staple plate formed with a circular opening is mounted on the lid of a footlocker or trunk and a hasp is mounted on the stationary portion of the footlocker, the hasp having a hinged portion provided with a lock assembly which includes a spring-loaded slide bolt and a key-operated lock mechanism for selectively engaging and locking the slide bolt, the hinged portion being swingable into an upright position where the slide bolt is spring-biased into engagement in the circular opening of the staple plate. A finger tab is operably connected to the slide bolt to release the slide bolt from engagement with the staple plate when the slide bolt is not engaged or blocked by the lock mechanism.

7 Claims, 2 Drawing Sheets

CLOSURE FOR A LIDDED CONTAINER

FIELD OF THE INVENTION

The present invention relates, in general, to closures for lidded containers, and, more particularly, to a closure for a footlocker or trunk.

BACKGROUND OF THE INVENTION

Normally, footlockers and trunks have a closure formed by a hinged hasp provided with a key-operated lock assembly and mounted on the stationary lower part of the footlocker, the hasp being swingable into engagement by the lock assembly with a staple plate mounted on the lid of the footlocker. Once this is done, the hasp is locked in place and can only by opened by using a key to release the lock assembly from the staple plate. This can prove to be a great inconvenience, since the key is not always readily available and the intent of the user may have been only to open the lid for a moment, but then automatically slapping the hasp shut without thinking rather than leaving the hasp hanging down in a position where someone walking by might scrape a leg on the exposed lock assembly.

OBJECTS OF THE INVENTION

It is therefore an object of the present invention to provide an improved closure for a footlocker or trunk which will obviate the aforementioned drawbacks.

It is another object of the present invention to provide a closure which can be opened without using a key, unless the closure has been deliberately closed using a key.

SUMMARY OF THE INVENTION

The above and other objects are attained by a closure in which a staple plate formed with a circular opening is mounted on the lid of a footlocker or trunk and a hasp is mounted on the stationary portion of the footlocker, the hasp having a hinged portion provided with a lock assembly which includes a spring-loaded slide bolt and a key-operated lock mechanism for selectively engaging and locking the slide bolt, the hinged portion being swingable into an upright position where the slide bolt is spring-biased into engagement in the circular opening of the staple plate. A finger tab is operably connected to the slide bolt to release the slide bolt from engagement with the staple plate when the slide bolt is not engaged or blocked by the lock mechanism.

The hinged portion of the hasp is formed with a slot and the staple plate is provided with a projecting staple, whereby when the hinged portion is swung up into engagement with the staple plate, the staple projects through the slot and can be engaged by a separate padlock.

The hinged portion of the hasp is also hinged outwardly of the mounting of the hasp on the footlocker, whereby when the hinged portion is not in engagement with the staple plate, the hinged portion swings downwardly.

By contrast with locks which require a spring action after button activation for release, the depressing of the finger tab creates, in the device of the invention, three separate yet very important actions simultaneously.

1. It releases the slide bolt.

2. Due to the angle of the tab, it pulls the lock off the circular opening this eliminating the need for a spring or a manual secondary operation.

3. The lock hasp is then caused to move downwards, by gravity and reaches its resting position without springs or a secondary manual operation.

BRIEF DESCRIPTION OF THE DRAWING

The above and other objects, features and advantages of the invention will become more readily apparent from the following description, reference being made to the accompanying drawing, in which.

SPECIFIC DESCRIPTION

Figure 1:
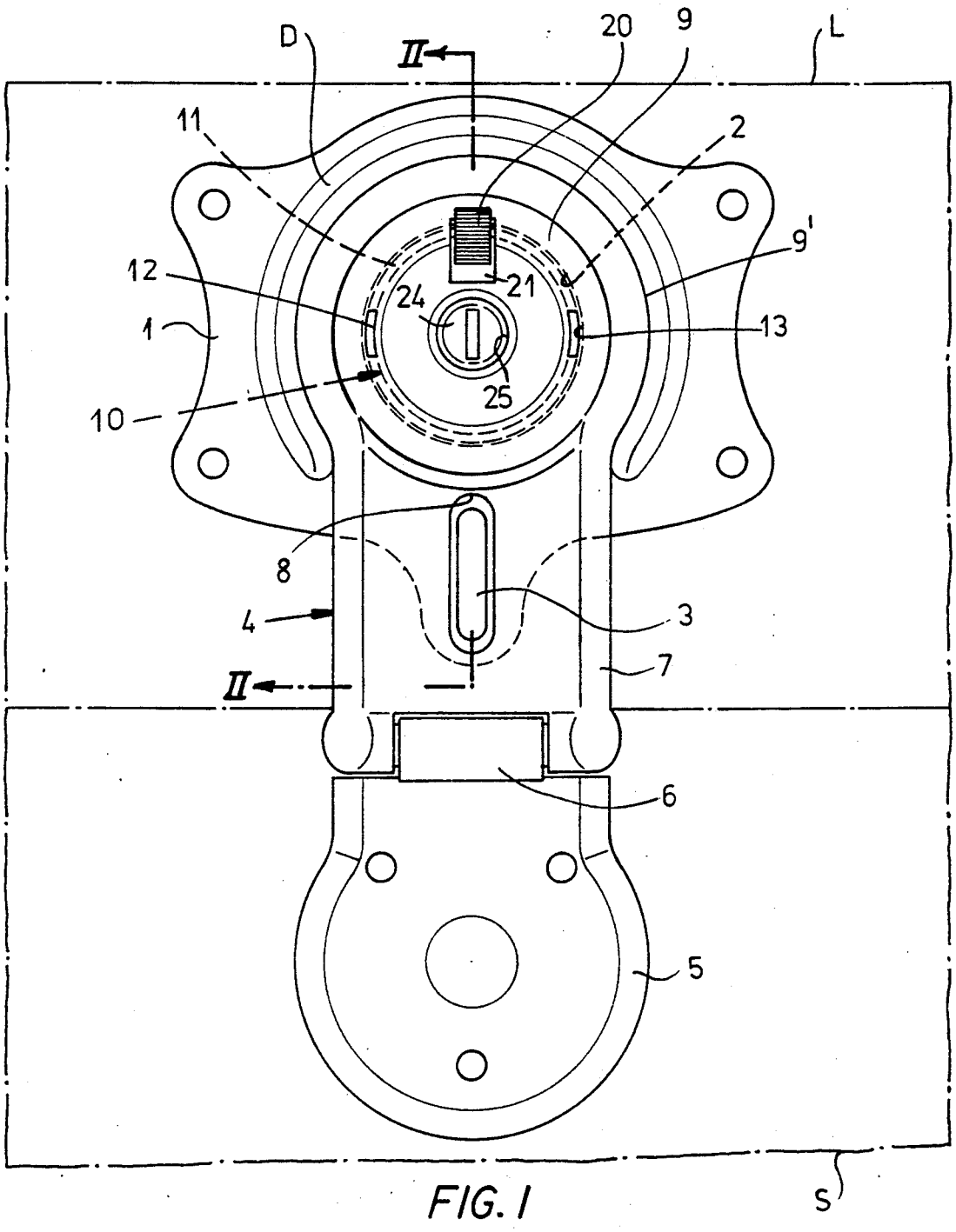
FIG. 1 is a front elevational view of the closure according to the invention.
Figure 2:
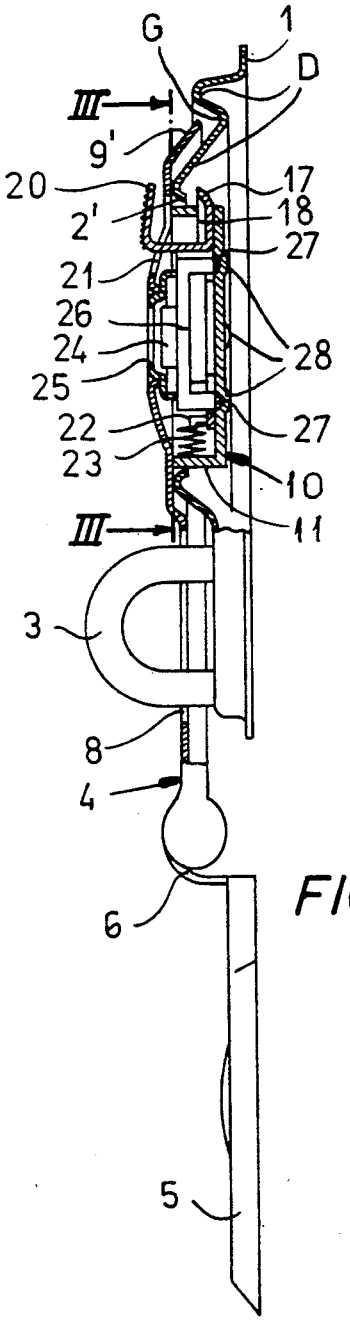
FIG. 2 is a sectional view taken along line II—II of FIG. 1.
Figure 3:
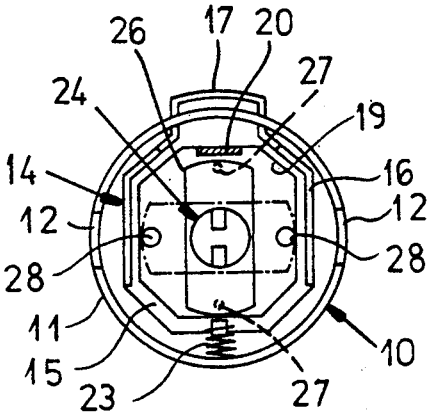
FIG. 3 is a sectional view taken along line III—III of FIG. 2.

In FIG. 1, the closure for a footlocker is shown in the closed position thereof, with a staple plate 1 mounted on a lid L of the footlocker, which has been illustrated in phantom lines for clarity, the staple plate 1 being formed with a circular opening 2 having a lip 2' and a projecting staple 3, the plate 1 having circular deformations D defining a groove G which act to provide rigidity to the plate and proper centering for a hasp 4.

The hasp 4 is shown mounted on a stationary portion S of the footlocker by a mounting plate 5 having a hinge 6 on which is pivoted a swingable portion 7 of the hasp, which is formed with a slot 8 through which the staple 3 can project and a circular head 9 having a flange 91 which coacts with the groove G to provide proper centering for the swingable portion 7 of the hasp 4.

A lock assembly 10 has a circular lock housing 11 mounted on the swingable portion 7 by arcuate keys 12 wedged into arcuate slots 13 formed in the head 9, and in which there is disposed a slide bolt 14 having a flat portion 15 flanked by sidewalls 16 and formed with an extended narrowed tongue 17 which projects through a slot 18 formed in the housing 11. The flat portion 15 is further formed with an opening 19 and a finger tab 20 which extends through a cutout 21 formed in the head 9, and a spring tab 22 which engages a compression spring 23 abutting the housing 11 and which acts to bias the slide 14 with the tongue 17 in an extended position.

A key-operated lock mechanism 24 is disposed in the opening 19 in axial alignment with a circular opening 25 formed in the head 9 and has an oblong body 26 which can be turned through 90°, as illustrated in phantom lines, by a key inserted through the opening 25. The body 26 is provided with a pair of projections 27 which index with pairs of dimples 28 formed in housing 11 in the two different positions of the body 26.

In operation, when the hasp portion 7 is swung into an upright position against the staple plate 1, the tongue 17 of the slide bolt 14 is cammed inwardly by the lip 2' of the circular opening 2 until the tongue clears the lip and is biased outwardly by the spring 23 acting on the slide bolt 14, the tongue 17 then being engaged behind the lip 2' and the hasp portion 7 is held in a closed position.

At this point the slide bolt 14 can be locked closed by operating the lock mechanism 24, using a key, into a position in which the body 26 engages the finger tab 20, preventing any retraction of the tongue 17 from behind the lip 2'.

If the slide bolt 14 is not locked closed by the lock mechanism 24, the swingable hasp portion 7 can be released from the staple plate 1 simply by sliding the finger tab 20 downwardly in the direction of gravity, thereby operating the slide bolt 14 to retract the tongue 17 to clear the lip 2'.

Once the swingable hasp portion 7 is released from the staple plate I, it always swings downwardly by gravity since the hinge 6 lies outwardly of the mounting plate 5, directly centered in the plane of the inner side of the lip 2' so that the release of the tongue 17 from behind the lip places the plane of the hasp portion 7 beyond top dead center, moving away from the plate 1.

I claim:

1. A trunk lock, comprising:

a staple plate mounted on a trunk lid and formed with a circularly extending ridge defining a generally circular groove, a staple projecting from said staple plate below said groove, and a circular opening spaced inwardly from said groove and above said staple;

a hasp having a fixed portion mounted fixedly on a body of a trunk formed with said lid and swingable portion connected by a hinge with said fixed portion, said swingable portion having a narrow elongated part connected with said hinge and formed with a slot through which said staple can pass, said swingable portion further having a wide part of generally circular configuration on a free end of said narrow part and fitting into said groove;

a lock assembly on said hasp and including a spring-loaded upwardly movable slide bolt receivable in said opening upon closing of the trunk lock to swing said hasp into an upright position with said wide part fitting into said groove so that said bolt engages behind a margin of said opening, and a key-operated lock mechanism extending into said opening in a closed position of the lock for selectively engaging and locking said slide bolt; and a finger tab operatively connected to said slide bolt, linearly movable downwardly in a slot formed in said wide part to release said slide bolt from engagement with said staple plate when said slide bolt is not held locked by said mechanism.

2. The trunk lock defined in claim 1 wherein said swingable portion is hinged outwardly of the mounting of said hasp on said body of said trunk, whereby when said swingable portion is not in engagement with said staple plate, said hinged portion swings downwardly.

3. The trunk lock defined in claim 1 wherein said slide bolt has a flat portion flanked by sidewalls and formed with an extended narrowed tongue which engages in said opening of said staple plate.

4. The trunk lock defined in claim 3 wherein said flat portion is formed with an opening in which said lock mechanism is disposed, said lock mechanism having an oblong outline which acts to block the slide bolt in the locking position of said lock mechanism.

5. The trunk lock defined in claim 4 wherein said lock assembly is enclosed in a lock housing mounted on said wide part, said tongue extending through a slot formed in said housing, said housing being further formed with two pairs of oppositely disposed dimples adapted to fit projections on said lock mechanism and acting to hold said lock mechanism in either an open or a closed position.

6. The trunk lock defined in claim 1 wherein said finger tab lies outwardly of said hinge and force thereon acts in the direction of gravity when releasing said slide bolt from engagement with said staple plate.

7. The trunk lock defined in claim 1 wherein said finger tab is unitary with said slide bolt and is engaged by said lock mechanism in the locking position thereof.

* * * * *